US009392818B2

(12) United States Patent
Zitturi et al.

(10) Patent No.: US 9,392,818 B2
(45) Date of Patent: Jul. 19, 2016

(54) CIGARETTE PAPER FOR SELF-EXTINGUISHING CIGARETTES

(71) Applicant: DELFORTGROUP AG, Traun (AT)

(72) Inventors: Roland Zitturi, Innsbruck (AT); Dietmar Volgger, Schwaz (AT)

(73) Assignee: delfortgroup AG, Traun (AT)

( * ) Notice: Subject to any disclaimer, the term of this patent is extended or adjusted under 35 U.S.C. 154(b) by 0 days.

(21) Appl. No.: 14/648,371

(22) PCT Filed: Oct. 22, 2013

(86) PCT No.: PCT/EP2013/072004

§ 371 (c)(1),
(2) Date: May 29, 2015

(87) PCT Pub. No.: WO2014/082796

PCT Pub. Date: Jun. 5, 2014

(65) Prior Publication Data

US 2015/0289560 A1 Oct. 15, 2015

(30) Foreign Application Priority Data

Nov. 30, 2012 (DE) ..... 10 2012 111 635

(51) Int. Cl.

| | |
|---|---|
| ***A24D 1/02*** | (2006.01) |
| ***D21H 11/00*** | (2006.01) |
| ***D21H 13/00*** | (2006.01) |
| ***D21H 15/00*** | (2006.01) |
| ***A24C 5/00*** | (2006.01) |

(52) U.S. Cl.

CPC ..... *A24D 1/025* (2013.01); *A24C 5/005* (2013.01)

(58) Field of Classification Search

None

See application file for complete search history.

(56) References Cited

U.S. PATENT DOCUMENTS

| | | | | |
|---|---|---|---|---|
| 2004/0261805 | A1 | 12/2004 | Wanna | |
| 2008/0149241 | A1 | 12/2008 | Sherwood | |
| 2008/0295854 | A1* | 12/2008 | Li | A24D 1/025 131/365 |

FOREIGN PATENT DOCUMENTS

| | | |
|---|---|---|
| EP | 0864259 | 9/1998 |
| WO | WO 2008/0146170 | 12/2008 |
| WO | WO 2008/0149241 | 12/2008 |
| WO | WO 2012/0158786 | 11/2012 |

OTHER PUBLICATIONS

International Searching Authority—European Patent Office, International Search Report, PCT/EP2013/072004, dated Feb. 21, 2004; 3 pages.

International Searching Authority—European Patent Office, English Translation International Preliminary Report on Patentability, PCT/EP2013/072004, dated Jun. 2, 2015; 8 pages.

* cited by examiner

*Primary Examiner* — Michael H Wilson
*Assistant Examiner* — Phu Nguyen
(74) *Attorney, Agent, or Firm* — Sunstein Kann Murphy & Timbers LLP

(57) ABSTRACT

The invention relates to a cigarette paper for self-extinguishing cigarettes. The cigarette paper comprises bands onto which a material reducing the diffusion capacity is applied, wherein a band comprises two band-like outer zones (18*a*, 18*b*) and a band-like central zone (20) therebetween. The said material is applied substantially over the entire surface up to the outer zones (18*a*, 18*b*) of the band (10). The aforementioned material is additionally applied to at least 70%, preferably at least 75% and/or at most 95%, preferably at most 90% of the surface of the central zone (20). The surface (22) to which the said material is applied is path-connected. The surface of the central zone (20), to which the said material is applied is likewise path-connected.

32 Claims, 5 Drawing Sheets

| Print Pattern | Printed fraction of central zone [%] | SE [%] | FB [%] | CO [mg/cig] |
|---|---|---|---|---|
| 6 mm wide,entire surface | 100.00 | 100 | 15 | 11.22 |
| Fig. 2 | 92.80 | 100 | 30 | 10.55 |
| Fig. 3 | 90.88 | 100 | 78 | 10.79 |
| Fig. 4 | 83.20 | 95 | 90 | 11.06 |
| Fig. 5 | 76.00 | 80 | 100 | 10.42 |
| Fig. 6 | 74.56 | 70 | 100 | 10.69 |
| Fig. 7 | 84.16 | 68 | 100 | 10.67 |
| Fig. 8 | 70.24 | 60 | 100 | 10.49 |
| Fig. 9 | 67.84 | 45 | 100 | 10.53 |

CIGARETTE PAPER FOR SELF-EXTINGUISHING CIGARETTES

FIELD OF THE INVENTION

The present invention relates to a cigarette paper which provides a cigarette manufactured therefrom self-extinguishing properties; acceptance of this cigarette by the smoker is affected as little as possible and the carbon monoxide content in the smoke is reduced compared to comparable cigarettes. In particular, it relates to a cigarette paper to which a pattern in the shape of bands with specific properties is applied, and to a cigarette manufactured therefrom.

BACKGROUND AND PRIOR ART

It is a goal of the tobacco industry to produce cigarettes which have a lower tendency to start fires. Such cigarettes are already part of statutory requirements in various countries and regions, for example, USA, Canada, Europe or Australia. To determine whether a cigarette has a reduced tendency to start fires, a test described in ISO 12863 or ASTM E2187 is used.

In this test, a smouldering cigarette is placed on a defined substrate, for example 10 layers of Whatman No. 2 filter paper, and observations are made as to whether the cigarette extinguishes before the entire visible tobacco part has smouldered away. This is called "self-extinguishment" (SE). The fraction of cigarettes which extinguish by themselves on the substrate is given as a percentage of the total number of tested cigarettes. In many cases the statutory requirements require that at least 30 out of 40 tested cigarettes have to extinguish, thus SE≥75%.

One way in which a cigarette self-extinguishes in this test consists in printing bands in cross-direction on the cigarette paper so that they are located in the circumferential direction on a cigarette manufactured from this cigarette paper. These bands can consist of any kind of materials; as an example, cellulose, cellulose derivatives, starch, starch derivatives or alginates have attained commercial relevance.

These bands primarily function by obstructing the access of oxygen to the glowing cone of the cigarette and thereby lead to the self-extinguishing of the cigarette. Since the access of oxygen during smouldering is primarily determined by the concentration difference between the inside of the cigarette and the surroundings, i.e. by diffusion, it is important to select a sufficiently low diffusion capacity for these bands.

The measurement of the diffusion capacity of such bands can be carried out with an appropriate measuring apparatus from the company Sodim ($CO_2$ Diffusivity Meter). The diffusion capacity thereby describes a transport of gas through the cigarette paper driven by a concentration difference. It therefore indicates the volume of gas flowing through the paper per unit time, per unit area and per concentration difference and hence has the unit $cm^3/(cm^2\ s)=cm/s$.

The low diffusion capacity necessary for self-extinguishing of the cigarette of the bands applied to the cigarette paper not only obstructs the transport of oxygen to the glowing cone, but also the transport of gases, in particular carbon monoxide, from the inside of the cigarette to the outside into the surroundings. Therefore, a higher carbon monoxide content is observed in the smoke of a self-extinguishing cigarette equipped with bands compared to the same cigarette without bands. However, the potentially increased fire safety should not increase the toxicity of the smoke, for which reason there is great interest in at least not increasing the carbon monoxide content in the smoke. Additionally, the carbon monoxide content in the smoke is also limited by statutory requirements in some countries.

A further disadvantage of self-extinguishing cigarettes is that the material which is applied in bands to the cigarette paper is burnt with the tobacco part of the cigarette, is smoked by the smoker and can thereby change the gustatory sensation of the cigarette. Here again, there is great interest in minimizing such changes in taste.

Finally, even if the cigarette has self-extinguishing properties on a suitable substrate, the cigarette should not extinguish by itself during normal smoking, for example, in the ashtray. Repeated lighting of a cigarette severely affects the acceptance of such cigarettes by the smoker and furthermore can have a negative influence on the composition of the smoke with respect to its toxicity.

A test to determine self-extinguishing during free smouldering, that is without substrate, has not been standardized and is also not part of statutory requirements. In most cases the cigarette is conditioned in accordance with ISO 3402 then lit and placed in a horizontal position so that air has unrestricted access to the cigarette from all sides by free convection. A certain number of cigarettes, for example 40 pieces, are tested according to this procedure and the fraction of cigarettes for which the entire visible tobacco part of the cigarette smoulders away, that is, the cigarette does not extinguish by itself, is determined. This fraction is often denoted as Free-Burn (FB) and given as a percentage. Although it is not part of statutory requirements, there is great interest in the industry for as few cigarettes as possible to be extinguished in this test, i.e. for the value of FB to be as high as possible. Generally, a value of at least 30% for FB is acceptable; preferably, the value should be 70% or higher.

In the prior art it is known that a minimum width for the bands of 4 mm is required to obtain self-extinguishing properties at all. In practice, however, it turns out in most cases that for compliance with the statutory requirements, typically 6 mm wide bands on the cigarette, printed on their entire surface, are required. The necessary width of the bands essentially depends on the selected tobacco blend. The distance between the bands results usually from the length of the tobacco part of the cigarette, as it is often a legal requirement that at least two bands should be present on the tobacco part.

Overall, one would like to achieve the partially conflicting goals of a high value for SE and a high value for FB at unchanged taste and at an at least not increased carbon monoxide content in the smoke. Several development attempts in this direction have, however, only provided partial progress.

A known approach that has gained commercial acceptance consists in dividing a 6 mm wide band into two bands of 3 mm each and separating them 1 mm from each other. This improves the FB, but the area covered by the bands on the cigarette paper is the same as for the normal 6 mm wide bands, so that the amount of material applied in the bands is at least not lower, for which reason no advantages with respect to the taste or the carbon monoxide content of the smoke can be expected.

Alternatives, in which the band edges are not made straight but, for example, are in the shape of waves to achieve improvements in the FB value, have proved to be of little value. They apply considerable amounts of material to the cigarette paper which cannot directly contribute to self-extinguishing. Thus, more material or a larger printed area is needed in order to comply with the statutory requirements regarding self-extinguishing properties. This can have a negative influence on the taste and the carbon monoxide content in the smoke. Similar approaches, in which the band edges are straight but in which the amount of applied material decreases from the centre of the band towards the band edges were not successful for the same reason.

Thus, there is a need for better reconciliation of the partially conflicting aims described above.

SUMMARY OF THE INVENTION

The aim of the present invention is to provide a cigarette paper which provides a cigarette manufactured therefrom with SE values which are sufficiently high to comply with statutory requirements, but which also simultaneously provides an FB value which is as high as possible for this cigarette, as well as a reduced carbon monoxide content in the smoke and which influences the taste as little as possible.

This aim is achieved by means of a cigarette paper according to claim 1 and a process according to claim 16. Advantageous further embodiments are disclosed in the dependent claims.

The terms "printed", "printed area" or similar expressions as used below should not be limited in their meaning to material which has actually been printed, but also applies to material which has been applied by any process, for example by spraying.

According to the invention the aim is achieved in that the cigarette paper comprises bands which are applied to the cigarette paper such that they can be located in circumferential direction on a cigarette that can be manufactured therefrom, that is, essentially in cross-direction of the cigarette paper, and to which a material has been applied that reduces the diffusion capacity. In this regard, a band comprises two band-like outer zones and a band-like central zone therebetween which have the following properties:

- the outer zones of the band have a width of at least 0.4 mm and at most 1.0 mm, preferably at most 0.8 mm and particularly preferably at most 0.6 mm,
- the said material is applied to the outer zones of the band essentially over the entire surface,
- the outer zones border directly on the central zone,
- said material is not applied over the entire surface of the outer edges of the central zone,
- said material is applied to at least 70%, preferably at least 75% and at most 95%, preferably at most 90% of the area of the central zone,
- the area to which said material is applied is path-connected, and
- the area of the central zone to which said material is applied is path-connected.

The inventors have found that, compared to prior art bands, for this special band pattern a better balance can be achieved between the mutually conflicting properties of reliable self-extinguishing (high value for SE) on the one hand and the ability for free smouldering (high value for FB), a low amount of applied material and a low carbon monoxide concentration in the smoke on the other hand compared with prior art bands.

More precisely, the inventors have found that it is not necessary for the purpose of self-extinguishing for the band to consist of an area printed over the entire surface. Instead, it is sufficient for a relatively narrow outer zone, essentially printed over its entire surface, to inhibit smouldering sufficiently, but it is then not absolutely necessary for the area which is adjacent in the direction of smouldering, that is the central zone, to be printed over its entire surface. In this regard, the term "applied essentially over the entire surface" encompasses the case in which 100% of the outer zone is actually printed, as well as cases in which very small unprinted areas exist due to process-related variations.

Thus, the material applied in the central zone can contain openings, as long as three conditions are met. On the one hand at least 70%, preferably at least 75% of the area of the central zone should be printed, to ensure reliable self-extinguishing. Furthermore, the area to which the material is applied is path-connected in the topological sense. The means that between any two points of the printed area of a band there is always at least one continuous path which connects these two points and runs entirely within the printed area. Expressed simply, the openings in the printed area must not divide the printed area into a plurality of separated parts. Additionally, the central zone itself must be path-connected, i.e. between any two points of the printed area of the central zone of a band there is always a continuous path which connects the two points and runs entirely in the printed area of the central zone.

Investigations by the inventors have shown that the "path-connected" property is an essential criterion for ensuring self-extinguishing which is of importance on its own aside from the fraction of the area of the central zone to which material is applied. The band edges are preferably straight and parallel to each other. Deviations therefrom, for example undulating band edges, are less suitable for the purposes of the invention, but should also not depart from the scope of protection of the invention.

The "outer edges" of the central zone, to which reference was made above, are herein two virtual, straight lines, parallel to the band edges, which indicate at which location of the band, looking from the outside to the inside, the openings in the applied material start. While the material in the outer zones is essentially applied to the entire surface, the outer edge of the central zone, or in other words the border between the central zone and the adjacent outer zone, is defined by the line where said material is not applied to the entire surface but instead where one of said openings starts.

Preferably, the bands have certain symmetry properties. As initially mentioned, the bands are applied to the cigarette paper such that they are located in circumferential direction on a cigarette manufactured therefrom, that is, located essentially in cross-direction of the paper, that is, essentially orthogonal to the machine direction of the paper web through the paper machine. However, at the time of paper production it is not yet known in which direction the paper will smoulder on the finished cigarette, and so the bands should exhibit the same functional properties in both smouldering directions. Preferably, the pattern of the applied material within the band consists of two halves which are separated by a virtual centre line of the band, whereby the applied pattern of one half of the band can be translated into the applied pattern of the other half of the band by mirroring at the centre line or rotation by 180° about a point located on the centre line and an optional translation parallel to the centre line.

Preferably, the band has a width of at least 4 mm, particularly preferably of at least 5 mm. However, the band should not exceed a width of 10 mm, preferably of 7 mm. A width of about 6 mm has been found to be particularly suitable, which corresponds to the usual width of such bands in this field; however, a better FB value and a lower CO content in the smoke and overall less applied material are obtained due to the incomplete application of material in the central zone.

In preferred embodiments, the distance between the bands is at least 5 mm, preferably at least 10 mm and particularly preferably at least 15 mm. At the same time, the distance should be at most 50 mm, preferably at most 30 mm and particularly preferably at most 25 mm. Particularly preferably, the separation of the bands is selected such that at least two complete bands are located on a cigarette manufactured from this paper. Furthermore, the band should have a sufficiently low diffusion capacity to ensure self-extinguishing in accordance with ISO 12863. To this end, the band preferably has a diffusion capacity of at most 1.0 cm/s, preferably at most 0.8 cm/s and/or at least 0.01 cm/s, preferably at least 0.1 cm/s. These values refer to a measurement after conditioning the paper in accordance with ISO 187 with a $CO_2$ Diffusivity Meter from the company Sodim, using a measuring head with an opening of 4×20 mm. The opening of the measuring head should in this case be located entirely on the band. It should be understood that here, areas with and without applied material are located under the opening of the measuring head. This, however, should be disregarded when checking the measurement results against the mentioned limits.

Preferably, the amount of material applied to the band, given as the mass per applied area in the dry state, is at least 1 g/m$^2$, preferably at least 3 g/m$^2$ and/or at most 8 g/m$^2$, preferably at most 6 g/m$^2$. With such applied amounts, the desired properties can advantageously be achieved.

In a preferred embodiment the amount of material per printed area is essentially constant. In this regard, the term "essentially constant" should in particular mean that it varies by less than 10%, preferably less than 5%. If the application is carried out by roto-gravure printing, this can be achieved, for example, if the volumes of the recesses in the roto-gravure printing cylinder differ from each other by less than 10% preferably by less than 5%.

In an advantageous embodiment, the material for reducing the diffusion capacity comprises a material which is selected from a group consisting of starch, starch derivatives, cellulose, cellulose derivatives and alginates, or a mixture thereof. Furthermore, the material for reducing the diffusion capacity can contain a filler, particularly a carbonate or oxide, preferably chalk, magnesium oxide, aluminum hydroxide or a mixture thereof. Additionally or alternatively, the material for reducing the diffusion capacity can contain a burn additive, whereby tri-sodium citrate and tri-potassium citrate or a mixture thereof is particularly suitable.

The invention can be applied to all known cigarette papers, also independently of whether the paper is intended for machine-made or hand-made cigarettes.

In a preferred embodiment, the untreated cigarette paper has an air permeability in accordance with ISO 2965, which is between 5 CU and 300 CU, preferably between 10 CU and 200 CU. In this regard, additionally or alternatively, the untreated cigarette paper has a basis weight of between 10 g/m$^2$ and 60 g/m$^2$, preferably of between 20 g/m$^2$ and 40 g/m$^2$. The cigarette paper can comprise wood pulp, pulp from annual plants, particularly flax or hemp, or other fibrous materials, for example, sisal or jute or a mixture thereof.

Furthermore, the treated cigarette paper can contain a filler, the fraction of which with respect to the entire paper mass is at least 10% by weight, preferably at least 15% by weight and/or at most 45% by weight, preferably at most 40% by weight. In this regard, the filler can in particular be formed by a carbonate or an oxide, preferably by precipitated chalk, magnesium oxide, aluminum hydroxide or mixtures thereof. Furthermore, the cigarette paper preferably contains a burn additive, in particular tri-sodium citrate, tri-potassium citrate or a mixture thereof. In this regard, the fraction of the burn additive with respect to the mass of the untreated cigarette paper is preferably at most 5% by weight and particularly preferably between 0.5% by weight and 3.0% by weight.

In addition, the cigarette paper can be coated over the entire surface or parts of its surface with compositions which, for example, contain flavours or which influence the substances in the smoke, in particular the so-called Hoffmann analytes, as long as these compositions do not substantially contribute to self-extinguishing of a cigarette manufactured from this paper. Such coatings, if present, can be applied to one of the two sides of the paper or to both sides and they can be applied before or after application of the bands according to the invention.

The invention further relates to a process for the production of a cigarette paper according to one of the above-mentioned embodiments. In this regard, said material is preferably applied in the form of a composition, in particular a solution, an emulsion or a suspension which contains a solvent and said material. In this regard, the term "solvent" should be understood within its broad context and in particular should not suggest that the composition is actually a "solution" in the chemical sense; instead, as mentioned, suspensions are also possible as suitable and preferred compositions.

Preferably, the solvent is water, because it is toxicologically harmless. In fact, basically, organic solvents can also be employed, but residues always remain after drying the paper, which has a negative influence on the odour of the paper. The odour of such residues of organic solvents is occasionally perceived as disturbing, in particular when the cigarette pack is opened by the smoker for the first time.

The material which remains on the paper after drying has to be suitable for sealing the pores of the cigarette paper by forming a film on the surface of the paper or by penetrating into the pores, to reduce the diffusion capacity of the paper in the printed areas. For these purposes, the above-mentioned materials starch, starch derivatives, cellulose, cellulose derivatives as well as alginates or a mixture thereof are particularly suitable. For an oxidatively degraded, absolutely dry starch, the fraction with respect to the composition is 5% by weight to 30% by weight, preferably 10% by weight to 25% by weight. In many cases, the fraction of the material which remains on the paper in the composition will be selected according to the viscosity required by the application process.

Preferably, said composition is applied in a printing process, in particular a roto-gravure process or a flexographic process, which can be carried out easily and steadily on an industrial scale. An application by spraying is also possible, for example.

The application is thereby preferably onto that face of the cigarette paper which is facing the tobacco on a cigarette manufactured therefrom, that is, the inside. Usually, this is the wire-side, as it has a lower chalk content compared to the upper side, which has a positive effect on the optical appearance of the tobacco ash. An application onto the upper side, which per se is better suited for printing, is possible without any problems, but is not preferred.

Although an application of the material in multiple layers, with the usual drying process after application of each layer, is possible, the preferred embodiment consists in applying all of the material in one layer. This means that there is no need to position the individual layers of a band precisely one over each other. This is difficult, because the bands should not be visible on the cigarette and hence can hardly be detected by conventional sensors. This in practice means that the edges of the individual printed layers are not located precisely on top of each other, so that there is a gradual decrease in the applied amount of material in the transition from the printed to the unprinted areas, which is not desirable.

Since applying large amounts of an aqueous composition to the paper can cause the formation of wrinkles after drying, the composition can contain substances, for example propylene glycol or glycerin, which reduce this formation of wrinkles. Other substances, for example, colorants or flavours, can also be contained in the composition, as long as they do not have a substantial negative influence on self-extinguishing of a cigarette manufactured from this paper. Basically, legal and toxicological aspects are to be considered in the selection of all substances and materials.

In an advantageous embodiment, the paper is treated to remove or reduce the wrinkles. Preferably, the paper is moistened after application of the composition and a first drying process and then undergoes a further drying process, preferably under mechanical loads, for example, stretching and extending the paper web. This "mechanical" process for the removal of wrinkles is advantageous insofar as it makes the use of additional substances in the composition superfluous.

EXEMPLARY EMBODIMENTS

Figures 1, 2:
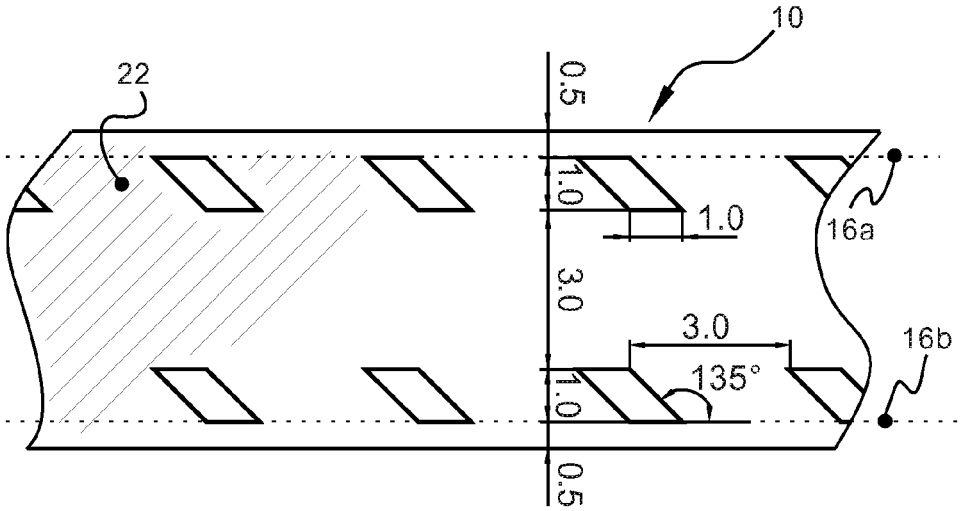
FIG. 1 shows a table with the results of tests with the print patterns of FIGS. 2-9 and a 6 mm wide band printed on the entire surface as a comparative example.
FIG. 2 shows a print pattern according to the invention; all dimensions are in millimeters.

For a better understanding of the present invention reference is made below to the preferred exemplary embodiments shown in the drawings which are described by means of specific terminology. It should be noted, however, that the scope of protection of the invention should not be limited thereby, as such changes and further modifications of the disclosed cigarette paper and the production process as well as further such applications of the invention as are disclosed therein are considered as routine current or future knowledge of the skilled person.

Figure 3:
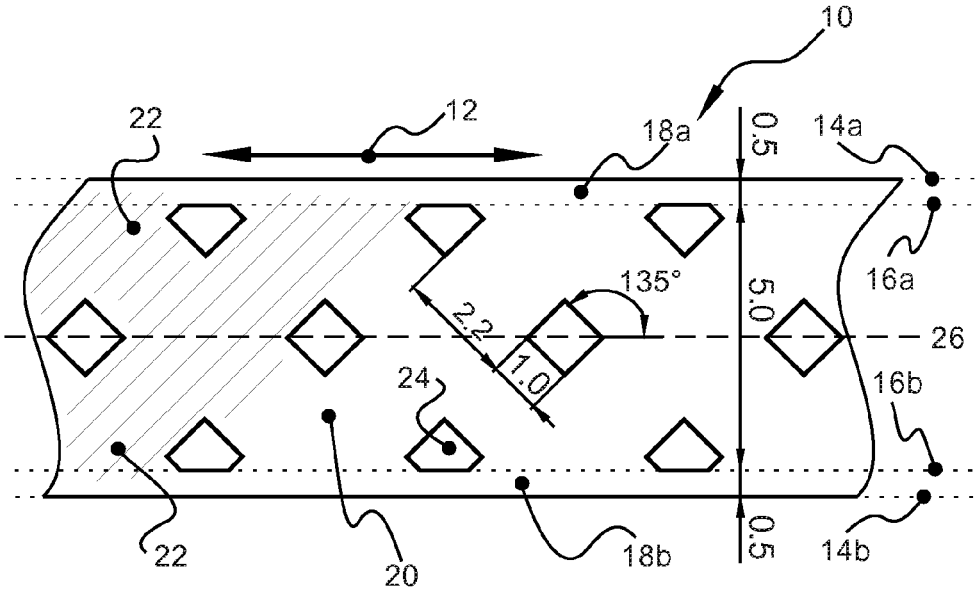
FIG. 3 shows a print pattern according to the invention and shows additionally the separation of a band into the outer and the central zone. All dimensions are in millimeters.

The separation of a band 10 into zones is explained by means of the print pattern shown in FIG. 3 by way of example. The band 10 runs on the paper in cross-direction, which is indicated by an arrow 12 and is delimited from the untreated cigarette paper (not shown) by two band edges, 14*a* and 14*b*. The virtual, straight, parallel lines 16*a* and 16*b* running in cross-direction, separate outer zones 18*a* and 18*b* from a central zone 20. One outer zone 18*a* is therefore located between the band edge 14*a* and the virtual line 16*a* and the other outer zone 18*b* is located between the band edge 14*b* and the virtual line 16*b*. The central zone 20 is delimited by the two virtual lines 16*a* and 16*b*.

The outer zones 18*a* and 18*b* are essentially printed over their entire surface, while the lines 16*a* and 16*b* themselves are not printed over their entire length. In addition, the central zone 20 is not printed over its entire surface. The printed area or the application area 22 is denoted in FIG. 3 by hatching in the left part of the figure and is interrupted by openings 24 without applied material.

In this sense, the central zone 20 is not "printed over the entire surface". The area 22 to which the material is applied is, however, path-connected in the topological sense. This means that between any two points of the printed area or the application area 22 of the band 10 there is a continuous path that runs entirely within the printed area 22. In this sense too, the printed area of the central zone 20 is path-connected.

Figure 6:
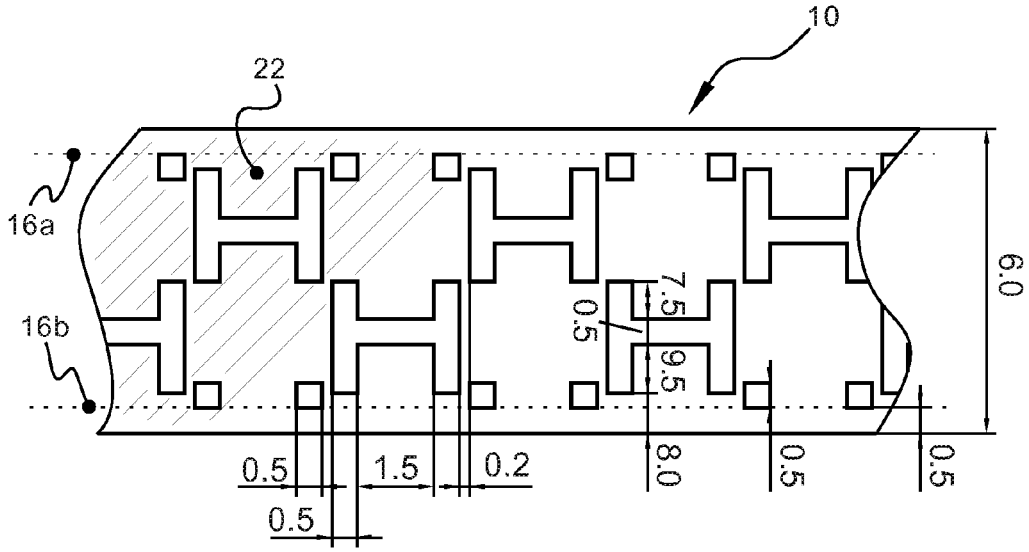

The band 10 of FIG. 3 is a mirror-image about a centre line 26 which extends in the longitudinal direction of the band 10. This means that the band 10 has the same self-extinguishing behaviour independently of the smouldering direction. Hence, there is no need to define at the manufacturing stage the direction in which a cigarette manufactured therefrom will smoulder. A symmetry which is also suitable for that purpose is a rotational symmetry about a centre that lies on the centre line 26. This is the case, for example, with the band of FIG. 2. In the band of FIG. 6, the two halves of the band above and below the centre line (not shown in FIG. 6) forming a mirror image at the centre line in combination with a parallel translation along the centre line, which is also a suitable symmetry for creating a behaviour which is independent of the smouldering direction.

As a cigarette paper, a commercial cigarette paper from wood pulp and precipitated chalk as filler with a basis weight of 24 g/m$^2$, a filler content of 33% by weight and an air permeability of 75 CU was used. The cigarette paper also contained 1% by weight tri-potassium citrate as burn additive.

To this cigarette paper, bands were applied with each of the print patterns from FIGS. 2-9 by roto-gravure printing. The applied composition consisted of water, 15.5% by weight absolutely dry, oxidatively degraded starch and 9.5% by weight chalk. For comparison also a 6 mm wide band, printed over the entire surface, was applied to the paper. The band separation was 18 mm in all cases.

The diffusion capacity of the bands was measured with a $CO_2$ Diffusivity Meter from the company Sodim, after conditioning the paper in accordance with ISO 187. The measuring head had an opening of 4×20 mm and was positioned such that the entire opening was located within the band. The diffusion capacity of all print patterns was between 0.09 cm/s and 0.60 cm/s.

From the cigarette papers, cigarettes with an American Blend tobacco blend were produced and 40 items were tested in accordance with ISO 12863 for their self-extinguishing properties and the value for SE was determined. In addition, the FB values of 40 items were tested. To this end, the cigarette was first conditioned in accordance with ISO 3402, then lit and, while smouldering, was mounted in a holder in the horizontal position, i.e. with the longitudinal axis of the cigarette orthogonal to the direction of gravity, so that air could flow freely to the smouldering cigarette from all sides. To this end, the cigarette was shielded from air flows so that gas transport was only due to free convection. The number of cigarettes for which the entire tobacco rod smouldered away without the cigarette extinguishing by itself was determined as a percentage of the number of tested cigarettes (FB).

The cigarettes were machine-smoked in accordance with a method specified in ISO 4387 and the carbon monoxide content in the collected gas phase was determined.

The results for SE and FB as well as the carbon monoxide (CO) content are listed in the table shown in FIG. 1. For each of the print patterns from FIGS. 2-9, the fraction of the printed area 22 lying in the central zone 20 is also given as a percentage of the entire area of the central zone 20.

The table of FIG. 1 shows that the value for SE decreases and the value of FB increases as the fraction of the printed area 22 in the central zone 20 decreases. The print pattern of FIG. 2 has an SE value of 100%, but the value for FB is rather low at 30%. However, since the value is significantly higher than that for a 6 mm wide band, printed over its entire surface, the print pattern according to FIG. 2 can also be considered to be in accordance with the invention. A small increase of the diffusion capacity can therefore increase the value of FB without jeopardizing a sufficient self-extinguishing property.

Figure 4:
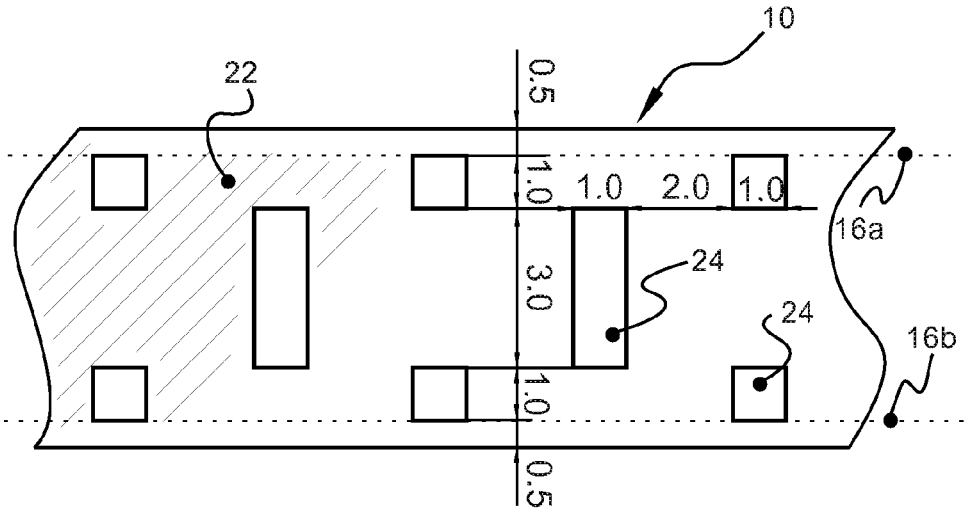
FIGS. 4-6 show print patterns according to the invention; all dimensions are in millimeters.
Figure 5:
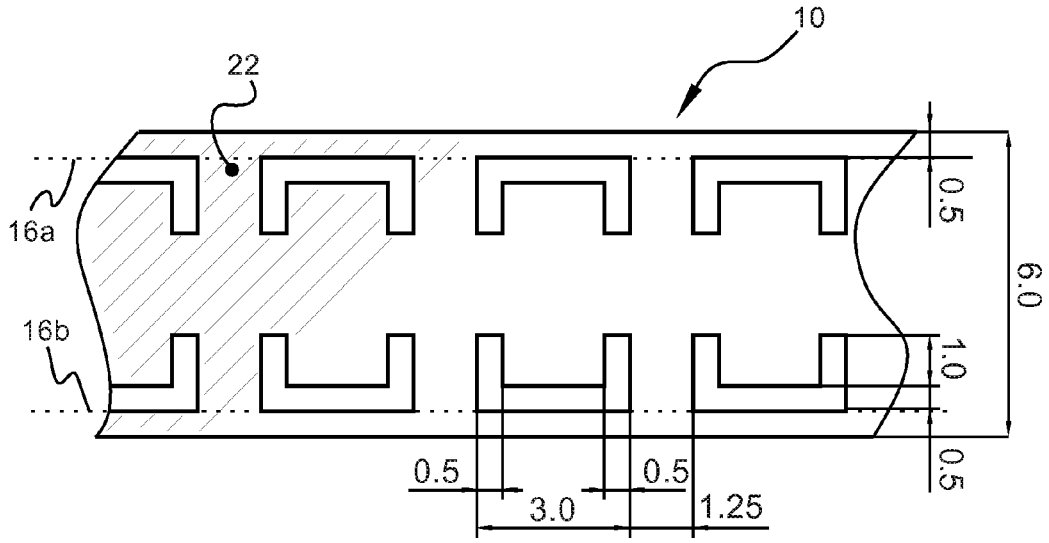

The print patterns of FIGS. 3-5 belong to the preferred embodiments, as for all these print patterns the value for SE as well as that for FB are very high.

The print pattern of FIG. 6 exhibits very good values for FB, but the value for SE is slightly below the usual statutory requirements of 75%, at 70%. Here, the value for SE can be increased by a slight reduction of the diffusion capacity without reducing that for FB too much.

Figure 7:
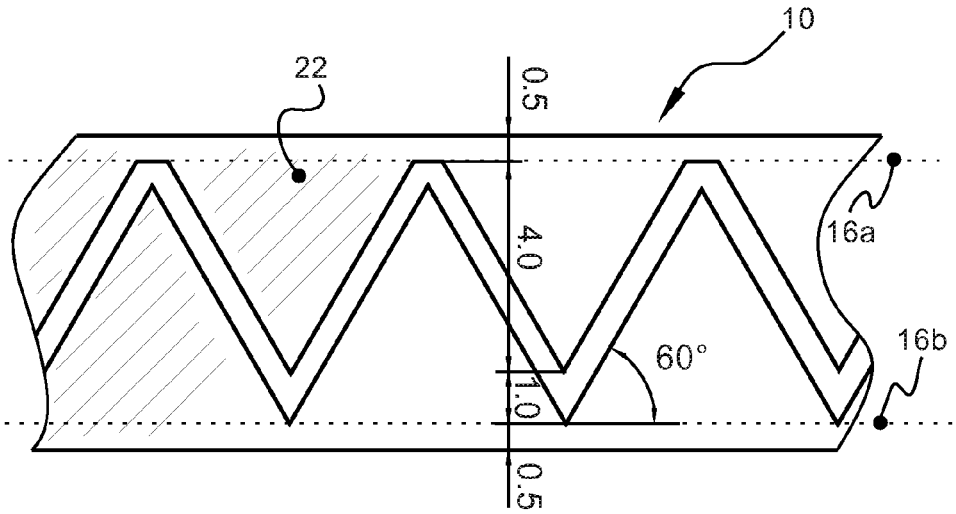
FIGS. 7-10 show print patterns not according to the invention; all dimensions are in millimeters.

The print pattern of FIG. 7 is not according to the invention, because the value for SE is not sufficiently high. This pattern shows that in spite of a high fraction of the printed area in the central zone 20 of 84.16%, sufficient self-extinguishing is not ensured. For this print pattern, neither the entire printed area 20 nor the printed area in the central zone 29 is path-connected, but instead it is broken down into two parts that both do not interact sufficiently strongly to ensure self-extinguishing. In the test for self-extinguishing, it turns out that the cigarette can continue to smoulder along the unprinted areas right through the band 10 and thereby goes beyond that band.

Figure 8:
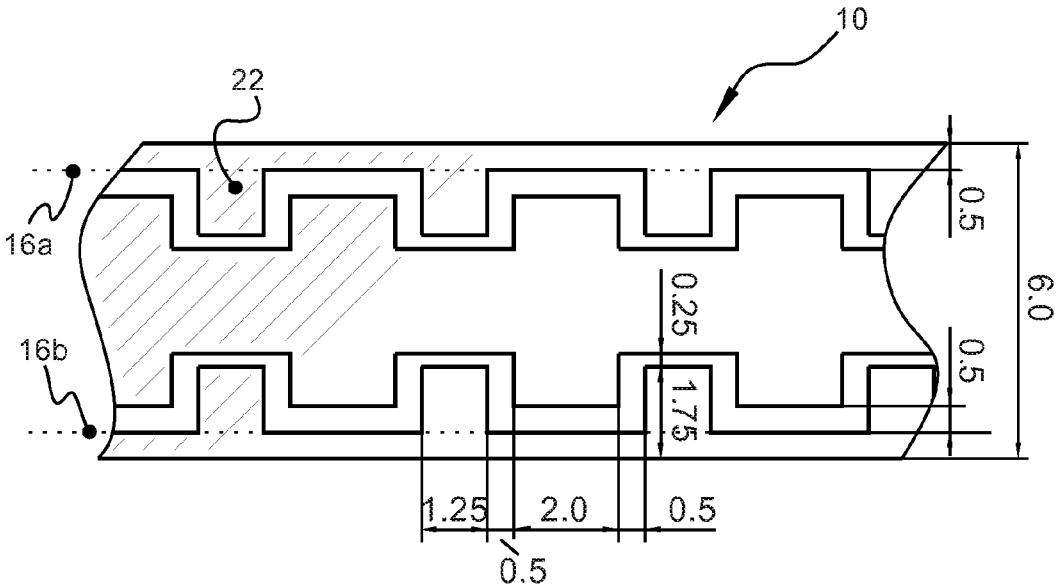

In addition, the print pattern of FIG. 8 is not path-connected and consequently not in accordance with the invention, but is broken down into three parts. Here again, it turns out that the rate of self-extinguishing (SE) is too low, at 60%.

Figure 9:
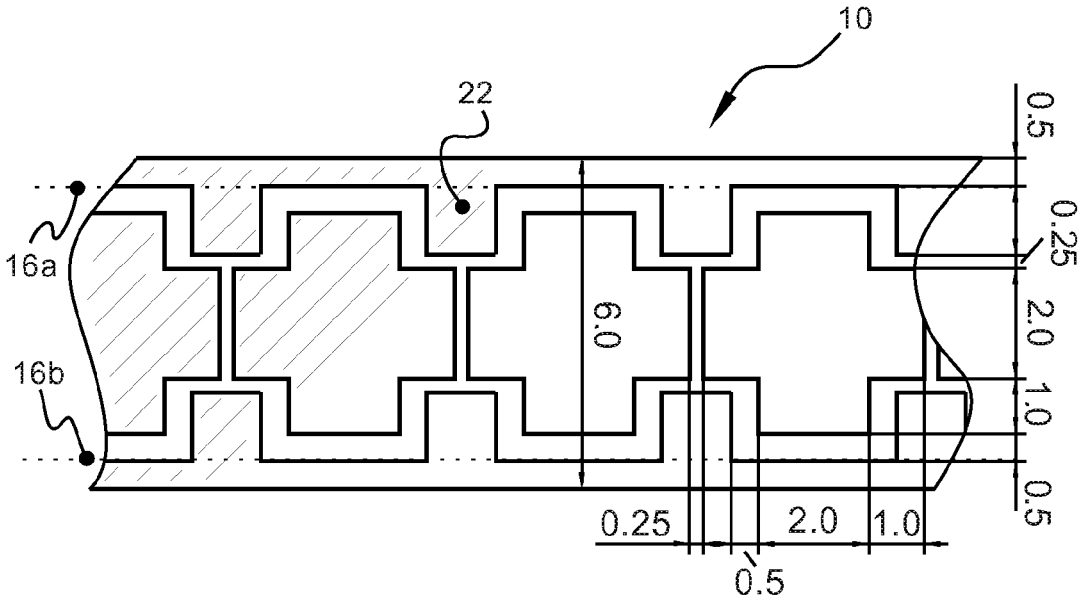

In addition, the print pattern of FIG. 9, with a fraction of 67.84% of the printed area 22 in the central zone 20, exhibits a rate of self-extinguishing which is significantly too low. This pattern is also not in accordance with the invention, as the fraction of the printed area in the central zone is too low and the central zone is also not path-connected, so that the cigarette can continue to smoulder along the unprinted channels in the band.

Figure 10:
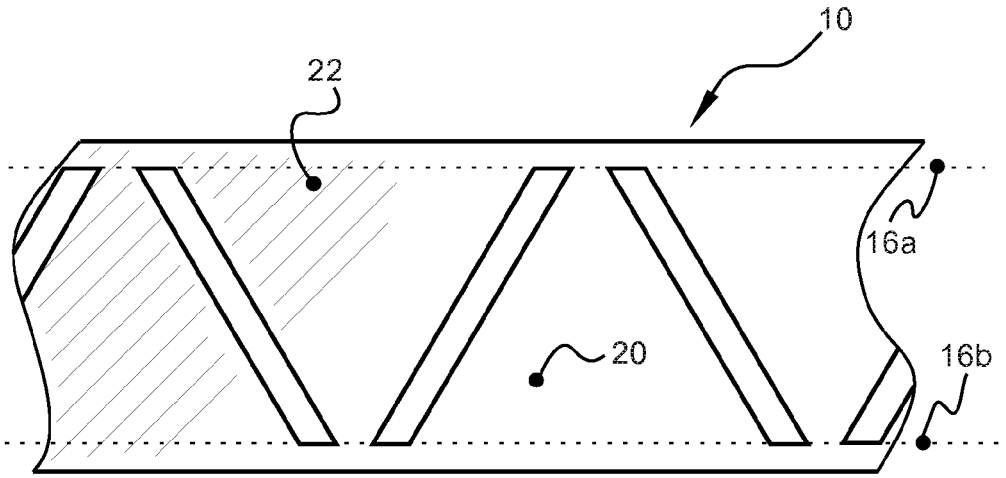

The print pattern 10 is also not in accordance with the invention. This pattern was not tested, as no substantially different behaviour was to be expected compared with the print pattern of FIG. 7, which is likewise not according to the invention. In the print pattern of FIG. 10, the printed area 22 is path-connected, while the printed area of the central zone 20 is not path-connected. This shows that both of these properties are of importance independently of each other.

By means of the values for carbon monoxide, it can be seen that all of the print patterns of FIGS. 2-9 result in lower values than a 6 mm wide band printed over its entire surface. Hence, there is an improvement over known prior art bands.

Additionally, for the print patterns of FIGS. 2-9, only 67.84% to 92.80% of the area of the central zone 20 is printed. This means a saving in the material from about 7% to about 23% compared to a 6 mm wide band printed over its entire surface, and hence a smaller influence on the taste of the cigarette.

In addition to these advantages, the patterns according to the invention can also be printed efficiently by a single-layer application, so that the variation of the amount of applied material within the printed area, as proposed in the prior art can be dispensed with.

Overall, contrary to expectations, it does not appear to be necessary for the band to consist of a several millimeter wide area printed over the entire surface, but a relatively narrow outer zone, essentially printed over the entire area suffices to sufficiently inhibit smouldering of the cigarette so that the adjacent areas of the band do not have to be printed over their entire surface. In fact, in the case of self-extinguishing, it is observed that the glowing cone does not continue to smoulder under the band, but already extinguishes right at the start of the band. On the other hand, no large unprinted areas and in particular no unprinted channels running in the longitudinal direction of the cigarette may be offered to the glowing cone behind the narrow zone printed essentially over its entire surface, as the glowing cone can smoulder through the band along these areas and channels.

The print patterns according to the invention are of such a kind that material is essentially only applied to the cigarette where it directly contributes to self-extinguishing. In this manner, the applied amount of material can be minimized and a reduction in the carbon monoxide content in the smoke and a minimization of the influence on taste is obtained.

LIST OF REFERENCE NUMERALS

10 band
12 cross-direction
14*a*, 14*b* band edges
16*a*, 16*b* edges of the central zone 20
18*a*, 18*b* outer zones
20 central zone
22 area of application
24 opening
26 centre line

The invention claimed is:

1. Cigarette paper for self-extinguishing cigarettes, wherein the cigarette paper comprises one or more bands which
- are arranged on the cigarette paper such that they can be located in a circumferential direction on a cigarette that can be manufactured thereof, and
- has a material which reduces the diffusion capacity applied thereto,
  - wherein each of the one or more bands comprises two band-like outer zones and a band-like central zone lying therebetween which has the following properties:
- the outer zones have a width of at least 0.4 mm and at most 1.0 mm,
- said material is applied essentially to the entire surface of the outer zones,
- the outer zones are directly adjacent to the central zone,
- said material is not applied to the entire surface of outer edges of the central zone,
- said material is applied to at least 70%, and at most 95% of area of the central zone,
- the area to which said material is applied is path-connected, and
- the area of the central zone to which said material is applied is path-connected.

2. Cigarette paper according to claim 1, in which the one or more bands have edges that are one or both of straight and parallel.

3. Cigarette paper according to claim 1, in which a pattern of application of said material within each of the one or more bands
- consists of two halves which are separated by a virtual centre line of the one or more bands, and
- can be translated into the pattern of application of the other half of the band by
  - forming a mirror image on the centre line or rotation by 180° about a centre lying on the centre line and
  - an optional parallel translation parallel to the centre line of the pattern of application of a half of the one or more bands.

4. Cigarette paper according to claim 1, in which each of the one or more bands have a width of at least 4 mm and wherein the one or more bands comprises a plurality of bands and wherein the distance between adjacent bands is at least 5 mm and at most 50 mm.

5. Cigarette paper according to claim 4, in which each of the one or more bands has a width of at least 5 mm.

6. Cigarette paper according to claim 4, in which each of the one or more bands has a width of at most 7 mm.

7. Cigarette paper according to claim 4, wherein the distance between adjacent bands is at least 10 mm.

8. Cigarette paper according to claim 4, wherein the distance between adjacent bands is at most 30 mm.

9. Cigarette paper according to claim 1, in which each of the one or more bands has a diffusion capacity of at most 1.0 cm/s and at least 0.01 cm/s.

10. Cigarette paper according claim 9, in which each of the one or more bands has a diffusion capacity of at most 0.8 cm/s.

11. Cigarette paper according claim 9, in which each of the one or more bands has a diffusion capacity at least 0.1 cm/s.

12. Cigarette paper according to claim 1, in which the amount of material applied to each of the one or more bands, given as mass per applied area in the dried state is at least 1 $g/m^2$ and at most 8 $g/m^2$.

13. Cigarette paper according to claim 12, in which the amount of material applied to each of the one or more bands, given as mass per applied area in the dried state is at least 3 $g/m^2$.

14. Cigarette paper according to claim 12, in which the amount of material applied to each of the one or more bands, given as mass per applied area in the dried state is at most 6 g/m.

15. Cigarette paper according to claim 12, in which the amount of material per area to which said material is applied varies by less than 10%.

16. Cigarette paper according to claim 1, in which said material is starch, starch derivatives, cellulose, cellulose derivatives and alginates, or a mixture thereof.

17. Cigarette paper according to claim 1, in which said material comprises one or both of a filler and a burn additive.

18. Cigarette paper according to claim 1, in which the untreated cigarette paper has a basis weight between 20 $g/m^2$ and 40 $g/m^2$.

19. Cigarette paper according to claim 1, which contains a filler, the fraction of which is at least 10% by weight and at most 45% by weight with respect to the entire paper mass.

20. Cigarette paper according to claim 1, which contains a burn additive, wherein the fraction of the burn additive is between 0.5% by weight and 3.0% by weight with respect to the mass of the cigarette paper.

21. Cigarette paper according to claim 1, wherein said outer zones have a width of at most 0.8 mm.

22. Cigarette paper according to claim 1, wherein said outer zones have a width of at most 0.6 mm.

23. Cigarette paper according to claim 1, wherein said material is applied to at least 75% of the area of the central zone.

24. Cigarette paper according to claim 1, wherein said material is applied to at most 90% of the area of the central zone.

25. Cigarette paper according to claim 1, in which the untreated cigarette paper has an air permeability in accordance with ISO 2965 between 5 CU and 300 CU.

26. Cigarette paper according to claim 1, in which the untreated cigarette paper comprises one or more of wood pulp, pulp from annual plants, sisal and jute.

27. Process for producing a cigarette paper which provides a cigarette which can be manufactured therefrom with self-extinguishing properties, having the following steps:

providing a base-cigarette paper, and applying a material which reduces the diffusion capacity of the base-cigarette paper in the form of one or more bands which are arranged such that they are located in the circumferential direction on a cigarette which can be manufactured therefrom, wherein each of the one or more bands comprises two band-like outer zones and a band-like central zone lying therebetween, the outer zones have a width of at least 0.4 mm and at most 1.0 mm, said material is applied to the outer zones essentially over the entire surface, said material is not applied over the entire surface to outer edges of the central zones, said material is applied to at least 70% and at most 95% of the area of the central zone, said material is applied such that the area of application is path-connected, and said material is applied such that the area of application of the central zone is path-connected.

28. Process according to claim 27, in which said material is applied in form of a solution, an emulsion or suspension, which contains a solvent and said material.

29. Process according to claim 28, wherein the solvent is formed by water and said material is formed by starch, a starch derivative, cellulose, a cellulose derivative or an alginate.

30. Process according to claim 27, in which said composition is applied by a printing process or sprayed.

31. Process according to claim 27, in which the composition contains substances which counteract the formation of wrinkles.

32. Process according to claim 31, in which the cigarette paper is moistened after the application step and a first drying and is dried in a further drying step under mechanical extension or stretching.

* * * * *